United States Patent [19]

Baba

[11] 4,419,955

[45] Dec. 13, 1983

[54] SYNCHRONIZED DRIVE MECHANISM FOR A LOADER AND A DESTACKER OF A PRESS

[75] Inventor: Kiyokazu Baba, Komatsu, Japan

[73] Assignee: Kabushiki Kaisha Komatsu Seisakusho, Tokyo, Japan

[21] Appl. No.: 421,337

[22] Filed: Sep. 22, 1982

[30] Foreign Application Priority Data

Oct. 12, 1981 [JP] Japan ..... 56-150016[U]
Oct. 12, 1981 [JP] Japan ..... 56-150017[U]

[51] Int. Cl.[3] ..... B05C 1/02

[52] U.S. Cl. ..... 118/227; 118/236; 100/196; 198/575

[58] Field of Search ..... 118/236, 227; 100/196, 100/215; 414/222; 198/575, 576

[56] References Cited

U.S. PATENT DOCUMENTS 2,814,269 11/1957 Stahr ..... 118/236
2,870,737 1/1959 Byrnes ..... 118/227
3,389,652 6/1968 Bruder et al. ..... 100/196 X

*Primary Examiner*—John P. McIntosh
*Attorney, Agent, or Firm*—Armstrong, Nikaido, Marmelstein & Kubovcik

[57] ABSTRACT

A synchronized drive mechanism for a loader and a destacker of a press including a drive shaft connected to a drive unit of the press, and a translating mechanism for translating the rotary motion of the drive shaft into a linear reciprocating motion and a swing motion. The loader is connected to the swing motion and moved thereby in a reciprocating fashion. A converting mechanism is provided for converting the linear reciprocating motion into an intermittent one way rotary motion for rotating a plurality of conveyors of the destacker intermittently in one direction. Thus the intermittent rotary movement of the conveyors is synchronized with the reciprocating movement of the loader thereby feeding blank sheets from the destacker to the loader and to the press to be realized.

5 Claims, 1 Drawing Figure

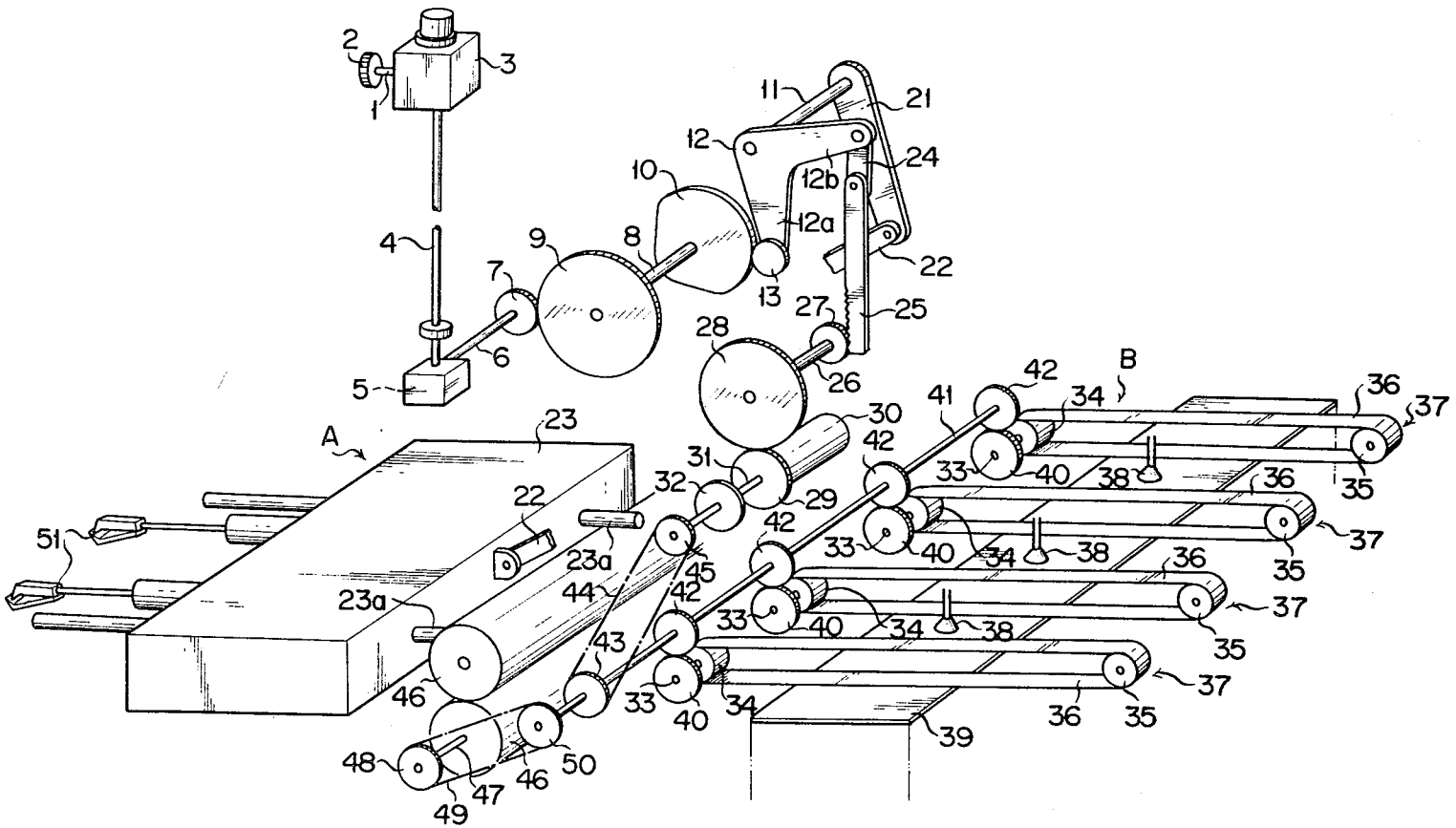
A
B

SYNCHRONIZED DRIVE MECHANISM FOR A LOADER AND A DESTACKER OF A PRESS

BACKGROUND OF THE INVENTION

This invention relates to an apparatus for driving a destacking conveyor for a press.

In the destacker for use in a press, there has so far been employed an arrangement in which the blank material attracted and picked up by means of a vacuum cup is conveyed by a destacking conveyor to a loader and then supplied by the loader to a press. Before the blank material is conveyed to the loader, it is applied with a processing oil by means of a processing oil coating means installed between the destacking conveyor and the loader.

The destacking conveyors of the kind specified have been arranged to be driven by an electric motor through a clutch and a brake, the intermittent operations of the clutch and the brake providing a synchronous operation of the loader of the press and the destacking conveyor. Further, on the delivery side of the destacking conveyor there have been provided a pair of oil coating rollers which are urged against each other and which are driven by the aforementioned electric motor through the clutch and the brake to thereby apply the blank material with the processing oil and at the same time convey it to the loader.

Therefore, the intermittent operations of the clutch and the brake during high speed operations have caused slips, deviations, timing delays and wear-down of the clutch and the brake etc., resulting in a timing delay in the drive of the loader thereby rendering it impossible to convey the blank material to the loader with a proper timing.

SUMMARY OF THE INVENTION

It is therefore an object of the present invention to provide a drive mechanism for a destacker which is able to drive destacking conveyors in synchronism with a loader.

Another object of the present invention is to provide an oil coating roller arrangement which is driven in synchronism with a loader.

A further object of the present invention is to provide a synchronized drive mechanisms for a combination of a loader, a destacker and oil coating rollers which is simple in construction yet can provide a reliable synchronization thereof.

In accordance with an aspect of the present invention, there is provided a synchronized drive mechanism for a loader and a destacker of press including drive means, comprising: a first shaft connected to and rotated by said drive means; means for translating rotary motion of said first shaft into a linear reciprocating motion and a swing motion; first connecting means for connecting the swing motion side of said translating means with said loader; said loader being adapted to move reciprocably in synchronism with a press stroke for feeding a blank material into the press; means for converting the linear reciprocating motion of said translating means into an intermittent one way rotary motion; conveyor means of said destacker for conveying the blank material to said loader; and second connecting means for connecting the intermittent one way rotary motion of said converting means with said conveyor means whereby said conveyor means is rotated intermittently in one way in synchronism with the reciprocating motion of said loader for conveying the blank material to said loader.

The above and other objects, features and advantages of the present invention will be readily apparent from the following description taken in conjunction with the accompanying drawing.

BRIEF DESCRIPTION OF THE DRAWING

Accompanying drawing is a schematic perspective view of a drive mechanism according to the present invention.

DESCRIPTION OF THE PREFERRED EMBODIMENT

The present invention will now be described in detail below by way of example only with reference to the accompanying drawing.

In the drawing, reference numeral 1 denotes a drive shaft mounted on the side of the press connected through a gear 2 to a press drive unit and the drive shaft 1 is connected through a coupling means 3 to a drive shaft 4 mounted on the side of a loader.

The drive shaft 4 on the side of the loader is connected through a bevel gear means 5 and a shaft 6 to a gear 7 which meshes with a gear 9 mounted on a cam shaft 8 that has a cam 10 fixedly secured thereto.

Located in abutting against the cam 10 is a cam follower 13 attached to one end **12*a* of a first lever 12 which is fixedly secured at an intermediate portion thereof to one end of a rotary shaft 11, the other end of which having a second lever 21 fixedly secured thereto. The second lever 21 is connected at its oscillating end to a carrier 23 of a loader "A" through a rod 22. The carrier 23 is arranged to be reciprocated along guide rods 23*a* to and from the press. Further, pivotally connected to the other end 12*b* of the first lever 12 through a link 24 is a rack 25 adapted to mesh with a pinion 27 rigidly mounted on a shaft 26. The shaft 26 is connected through gears 28, 29 and one-way clutch 30 to a shaft 31. The shaft 31 has a friction brake 32** mounted thereon.

Reference character "B" indicates a destacking conveyor provided continuously with the loader "A". The destacking conveyor "B" comprises a plurality of belt units 37 spaced apart and each including a belt 36 extending or wound round a drive roller 34 fixedly mounted on a drive shaft 33 and a driven roller 35. Located between the adjacent belts 36 are vacuum cups 38 adapted to be moved vertically by means of elevator means (not shown). Each of the belts 36 contains a magnet adapted to attract or pick up thereon a sheet of blank material 39 from among a plurality of blank materials stacked below the belts 36.

Meshing with one of gears 40 fixedly mounted on each of the drive shafts 33 is one of gears 42 fixedly mounted on a rotary shaft 41 which is connected through a sprocket 43, a chain 44 and a sprocket 45 to the shaft 31.

On the delivery side of the destacking conveyor "B" there are provided a pair of oil coating rollers 46, 46 which are urged against each other and extend in the direction of width of the conveyor. One of the oil coating rollers 46, 46 has a shaft 47 which is connected through a sprocket 48, a chain 49 and another sprocket 50 to the rotary shaft 41.

Thus, when the press is driven, the cam is rotated to swing the first lever 12 and the second lever 21, the swing action of the second lever 21 causing reciprocating movements of the carrier 23 relative to the press. As a result, jaws 51 are allowed to reciprocate in synchronism with the press.

Whilst, the swing action of the first lever 12 causes vertical reciprocating movements of the rack member 25 thereby rotating the shaft 26 forwardly and reversely through the pinion 27. Because the rotation of the shaft 26 is transmitted through the one-way clutch 30 and gear train to the rotary shaft 41, the shaft 41 is intermittently rotated in one direction so that the belts 36 may be intermittently rotated in one direction in synchronism with the reciprocating movements of the carrier 23.

Accordingly, the blank materials 39 attracted or picked up by the belts 36 will be conveyed in turn towards the loader "A" through the oil coating rollers 46, 46 in synchronism with the loading of the blank materials by means of the loader "A".

At that time, because the oil coating rollers 46, 46 are intermittently rotated or driven in one direction in synchronism with the rotary shaft 41, the pair of oil coating rollers 46, 46 which are urged against each other are intermittently driven in synchronism with the loader "A" so as to apply the blank materials fed in turn therebetween with the processing oil and at the same time convey them to the loader "A" in synchronism with the latter.

It is to be understood that the foregoing description is merely illustrative of a preferred embodiment of the invention, and that the scope of the invention is not to be limited thereto, but is to be determined by the scope of the appended claims.

What is claimed is:

1. A synchronized drive mechanism for a loader and a destacker of a press including drive means, comprising:

a first shaft connected to and rotated by said drive means;

means for translating rotary motion of said first shaft into a linear reciprocating motion and a swing motion;

first connecting means for connecting the swing motion side of said translating means with said loader;

said loader being adapted to move reciprocably in synchronism with a press stroke for feeding a blank material into the press;

means for converting the linear reciprocating motion of said translating means into an intermittent one way rotary motion;

conveyor means of said destacker for conveying the blank material to said loader; and second connecting means for connecting the intermittent one way rotary motion of said converting means with said conveyor means whereby said conveyor means is rotated intermittently in one way in synchronism with the reciprocating motion of said loader for conveying the blank material to said loader.

2. A synchronized drive mechanism as recited in claim 1 wherein said translating means comprises a second shaft operatively connected with said first shaft, a cam mounted on said second shaft, first lever means pivoted at an intermediate portion thereof, said first lever means having first and second end portions with the first end portion having a cam follower mounted thereon, a rack pivotally connected at one end thereof with the second end portion of said first lever means and second lever means pivoted at one end thereof, said first and second lever means having a common pivot axis.

3. A synchronized drive mechanism as recited in claim 2 wherein said converting means comprises a pinion gear engageable with said rack and rotated back and forth thereby as said rack reciprocates and one way clutch means for converting the back and forth rotation of said pinion gear into an intermittent one way rotary motion.

4. A synchronized drive mechanism as recited in claim 1 wherein said conveyor means comprises a plurality of conveyors each rotated intermittently in one way and having at least one magnet mounted thereon and wherein said destacker includes a plurality of suction pickup means mounted between said conveyors for picking up the blank material to said conveyors.

5. A synchronized drive mechanism as recited in claim 1 further comprising a pair of roller means arranged between said destacker and said loader for coating oil onto the blank material passing therethrough and third connecting means for connecting the intermittent one way rotary motion of said converting means with one of said roller means whereby both said roller means are rotated intermittently in opposite directions from each other in synchronism with the reciprocating motion of said loader for feeding the blank material from said destacker to said loader.

* * * * *